United States Patent [19]

Myrick

[11] 4,373,278

[45] Feb. 15, 1983

[54] SINGLE LINE DEEP-SEA BUCKET AND RELEASE

[76] Inventor: Edward E. Myrick, Rte. 2, Box 223, Killen, Ala. 35645

[21] Appl. No.: 263,917

[22] Filed: May 15, 1981

[51] Int. Cl.[3] ..... B66C 3/02; E02F 3/44

[52] U.S. Cl. ..... 37/71; 37/183 A; 37/184; 73/864.42

[58] Field of Search ..... 37/54, 71, DIG. 8, 183 R, 37/183 A, 184, 186; 73/864.42

[56] References Cited

U.S. PATENT DOCUMENTS

| | | | |
|---|---|---|---|
| 400,936 | 0/0000 | Morris | 37/186 |
| 1,477,679 | 3/1924 | Woolley | 37/184 |
| 2,242,940 | 5/1941 | Caoli | 37/184 |
| 3,036,393 | 5/1962 | Baird, Jr. | 37/184 |
| 3,357,506 | 12/1967 | De Bosredon | 175/99 |
| 3,762,078 | 10/1973 | Wetherbee | 37/54 |
| 3,949,497 | 4/1976 | Crump | 37/71 |
| 3,996,678 | 12/1976 | Amann et al. | 37/184 X |
| 4,116,069 | 9/1978 | Lezgintsev et al. | 37/71 X |
| 4,196,531 | 4/1980 | Balligand et al. | 37/54 |

FOREIGN PATENT DOCUMENTS

| | | | |
|---|---|---|---|
| 136992 | 8/1979 | Fed. Rep. of Germany | 37/71 |

*Primary Examiner*—Clifford D. Crowder
*Attorney, Agent, or Firm*—T. Eugene Burts

[57] ABSTRACT

A single line deep-sea bucket and release is provided for mining operations and emergency fouling situations at extreme depths. A clamshell mechanism is provided with a bucket support frame and a hoisting frame with coupling means maintaining a fixed connection on descent. The clamshell, descending in the normally open position, is closed on ascent by an operating cable actuated to close by a measured withdrawal of the two frames and coupling means to which the actuating cable is fastened. Emergency shell release opening is caused by gravity force of a descending messenger on the single hoisting cable to trip a release of the coupling means and thereby the attached withdrawn operating cable to descend and open the shell.

12 Claims, 10 Drawing Figures

SINGLE LINE DEEP-SEA BUCKET AND RELEASE

ORIGIN OF THE INVENTION

The invention described herein was made by a private individual as the result of individual experimental work; and is directed toward enhancement of the environment by encouraging and aiding in deep-sea exploration for the extraction of minerals from the bed of the ocean.

BACKGROUND OF THE INVENTION

1. Field of the Invention

This invention relates in general to excavation and load retrieval equipment, and it deals more particularly with a clamshell type bucket of the kind used for deep-sea mining operations and mineral retrieval. It is specifically directed to a single line deep-sea bucket which may be easily operated in remote depths in excavating minerals from the ocean floor, wherein there is provided such a bucket which may be easily retrieved when the same becomes engaged or locked accidentally on some obstruction in the operating area.

Heretofore, deep-sea clamshell type buckets which are operated from crane ships or barges have been of the multiple tether line type, requiring lines to be strung to the bucket at different angles in order to prevent entangling or the single line type adapted for removing material at great depths which have been provided with messenger means for closing the bucket at initial operation, but had no means for opening the bucket once it had locked for emergency situations.

It is well-known that, with the dwindling mineral resources of this country, mining of the ocean floor has become commonplace. As better exploratory methods are found, more areas on the ocean floor will be revealed where valuable mineral resources may easily be recovered for use in the domestic market without seeking these minerals abroad. It is well-known that present operations in the most favorable mineral locations are at depths ranging in hundreds to thousands of feet.

With such great distances between the tender ships or barges and the operating sea bucket or clamshell, a familiar hazard has become the current of the ocean itself in snarling the many tether lines which are necessary for the purpose of opening, closing and retrieving the deep-sea bucket. Hence, it is very desirable from this standpoint to eliminate as many tether lines running to the surface as possible, for often as the bucket descends it is caused by the current to move at great distances laterally away from its tender and revolve in motion while descending. Since there is no way in which one can observe the condition of these tender lines when they become entangled there is no alternative to bringing the bucket back to the surface, at great loss of time, and some expense, for the purpose of preparing it to descend again to do its job.

The few single line buckets which have been provided have been directed solely to the proposition of opening the bucket in its initial stages in order that it might receive its cargo or in closing the bucket in one operation in order that it might be locked onto its cargo for removal to the surface.

Another hazard, however, is encountered in the possible locking of a bucket onto an outcropping of rock or some other sunken marine object. When this occurs, and there is no means to disengage the bucket, the entire apparatus is lost since it must be cut loose from its tender without being retrieved. The present single line buckets do not provide for this hazard and the present multiple tether line buckets are no practicable in operation at great ocean depths in swirling currents. Hence there is need for a bucket of the single line type which will also be operational to release itself when it locks by accident upon a sunken object.

2. Discussion of Prior Art

After competent search, no existing devices of the type disclosed in the present invention were found, there being seven references which were considered, but which do not appear to conflict with the present invention or anticipate either the apparatus or the objects and purposes for which it was designed. The prior art discloses the following U.S. patents:

T. J. Wetherbee, U.S. Pat. No. 3,762,078
B. L. Crump, U.S. Pat. No. 3,949,497
F. Caoli, U.S. Pat. No. 2,242,940
J. Baird, Jr., U.S. Pat. No. 3,036,393
E. Woolley, U.S. Pat. No. 1,477,679
P. DeBosredon, 3,357,506
C. A. Morris, 400,936

Wetherbee discloses a Benthic dredge construction adapted for taking samples from the bottom of a body of water. In this patent, the clamshell bucket is maintained in the normally "open" position by means of the cables 34 and 35 having engaging loops over the retaining legs 30 of the members 29 which are secured to the operating bar 28. The spring 32 maintains the bar 28 and the members 29 biased away from the bucket such that the legs 30 project from the bracket 26 to receive the loops of the cables. When the bucket is positioned on the floor of the ocean, a messenger is sent down the cable 53 to strike the operating bar 28, moving the projecting members 30 through the bracket 26 to release the cables 34 and 35 and allow the bucket to snap into the closed position gathering a sample. There is no part of this patent which suggests any portion of the present invention, it being for a different purpose with different structure normally maintained in an exactly opposed position diametrically opposite to the present invention.

Crump discloses a releasing latch apparatus for a Benthic dredge which is an improvement over the patent to Wetherbee. It again deals with a clamshell type of bucket for deep-sea operations wherein the lower doors of the bucket are normally maintained in the open position by means of the cables 9 and 10 which are hooked over the latch pins 27. The clamshell closures 2 and 3 remain normally biased toward the closed position by means of a torsion spring 4. The upper ends of the cables 9 and 10 have loops which pass over the latch pins 27 which project through openings 25 in the elongate body cross member 15. A compression spring 34 is adapted to seat against one end of the plunger 23 and rest upon the web 8 of the bail 7, thereby holding the plunger in such position as to maintain the pins 27 projecting from the elongate body 15. In such position the pins hold the loops of the cable 9 and maintain the clamshell closures 2 and 3 in the open position. It can plainly be seen from both of the preceding patents which have been referred to that neither of them operate linkage to achieve the same purpose as that of the invention of the applicant. The messenger which is used in both instances is used to actuate mechanism which will allow the doors which are normally biased to the closed position to be released so that they may spring into the closed position to pick a sample from the bottom of the ocean floor. There is no suggestion by either of these patents of the structure or apparatus as disclosed in this case by the applicant.

Caoli discloses an automatic clamshell bucket which has a double linkage system which allows the bucket to be lowered in such manner that the clamshell closures 10 are in the open position. In this position, telescoping shaft 19 is such that it is in an upward position. When the tension is relieved on the cable 24 the shaft 19 is spring biased in such manner that it moves downwardly such that the lower end of the head 20 and shoulder 21 are caught under the projection 30 of the catch 29. When this engages the catch 29, an upward movement on the cable 24 pulls the entire pivotal connection at 12 upwardly forcing the linkage arms 17 downwardly in such manner as to close the closures 10. Nothing in this patent is used for the purpose of an emergency release of the doors by means of the structure disclosed by the applicant. Nor is there any suggestion in this structure of the same structure as the applicant's. Indeed, this is the type of structure which the applicant seeks to avoid since it entails the use of a separate line 39 in order to release or lock the closures 10 in the appropriate position.

The patent to Baird essentially shows a means for absorbing the shock when the clamshells open after being dropped. In this invention, there is a hoisting line 21 and also a release line 61 to release the mechanism and open the bucket. While the invention is referred to as a single hoist bucket, this is by reason of the fact that the bucket is lowered into position for operation by means of a single line, but in order to release the bucket the extra line 61 must be operated by the same operator to release the hook 34 which will allow the bucket to open. The shock absorbing mechanism is the principle object of the invention and therefore this structure does not in any way suggest the emergency opening feature as shown by the applicant in the instant invention, nor does this invention show the structure for operating a bucket which is shown in the present invention. There is nothing which would suggest the structure of the applicant.

The patent to DeBosredon shows a drilling bucket which is adapted to be operated in a shaft by hydraulic means. This bucket is so adapted that there is a casing which expands to impinge against the side of the hole in which the drilling is taking place in such manner as to prevent a vertical movement of the bucket while the clamshell is open. This type of arrangement does not in any way suggest the frame apparatus of the applicant or the release apparatus of the applicant in the structure which is disclosed by this patent.

Woolley shows a dredging bucket in which it might appear that there would be a similarity to the present device of the applicant because of the fact that tongs are used and a tongue is used in connection therewith. The application and interchange of use of these elements is entirely different, however, from that of the present invention. The upward pull on the hoisting cable 10 and the hoisting cable 6 results in a continuous operation of closing the bucket once it has been loaded such that it will not again release while beneath the surface of the water on the bottom of the ocean floor. These parts are not combined to enable one to release the bucket while tension is placed upon the hoisting cables to pull the bucket up to the surface. Therefore, the bucket might be engaged or hooked upon some outcropping of rock and there would be no means for disengaging the same as in the present invention. There is no similarity between this patent and the present invention and there is no suggestion of the present structure.

The patent to Morris shows a dredging bucket in which the structure is designed to prevent the shock of the drawing of the bucket toward the surface or the lowering of the bucket into the water by means of a spring assembly which takes up the concussion between the conical flange and the latches as the bucket is lowered to open the same. There is no suggestion of an emergency release mechanism nor a frame mechanism for supporting the bucket as in the present invention and there is the necessity of the use of the additional lines to the surface in order to release the bucket. This patent does not in any way anticipate the present invention.

SUMMARY AND OBJECTS OF THE INVENTION

A primary object of this invention is to provide a deep-sea bucket for mining the ocean floor which is easily operable at great depths without fouling of the hoist lines.

A feature in connection therewith is to provide a single line bucket in which the opening and closing mechanism for the clamshell is a unitary structure operable from the surface without additional operating lines likely to foul in swirling currents.

Another object is to provide in a single line hoist deep-sea bucket a structure which can be closed on the bottom by gravity drop means without the necessity of additional surface to bucket operating lines.

A feature in connection therewith resides in the provision of a bucket supporting frame and mechanism allowing the bucket to be lowered in open mode and automatically cocked into closing mode at the bucket frame without the necessity of linkage to the surface.

A most important object of the invention is to provide in a unitary structure supporting a bucket in closed mode on the bottom of the ocean and integral means for releasing and opening said bucket to release the closure in an emergency.

A feature in connection therewith is to provide a bucket structure with a single hoist line and means automatically operable on said structure to open the bucket on the bottom and release the same by a messenger member descended on said hoist line from the surface.

Other objects and features in connection therewith will be obvious from the following disclosure.

DETAILED DESCRIPTION OF THE INVENTION

Figure 1:
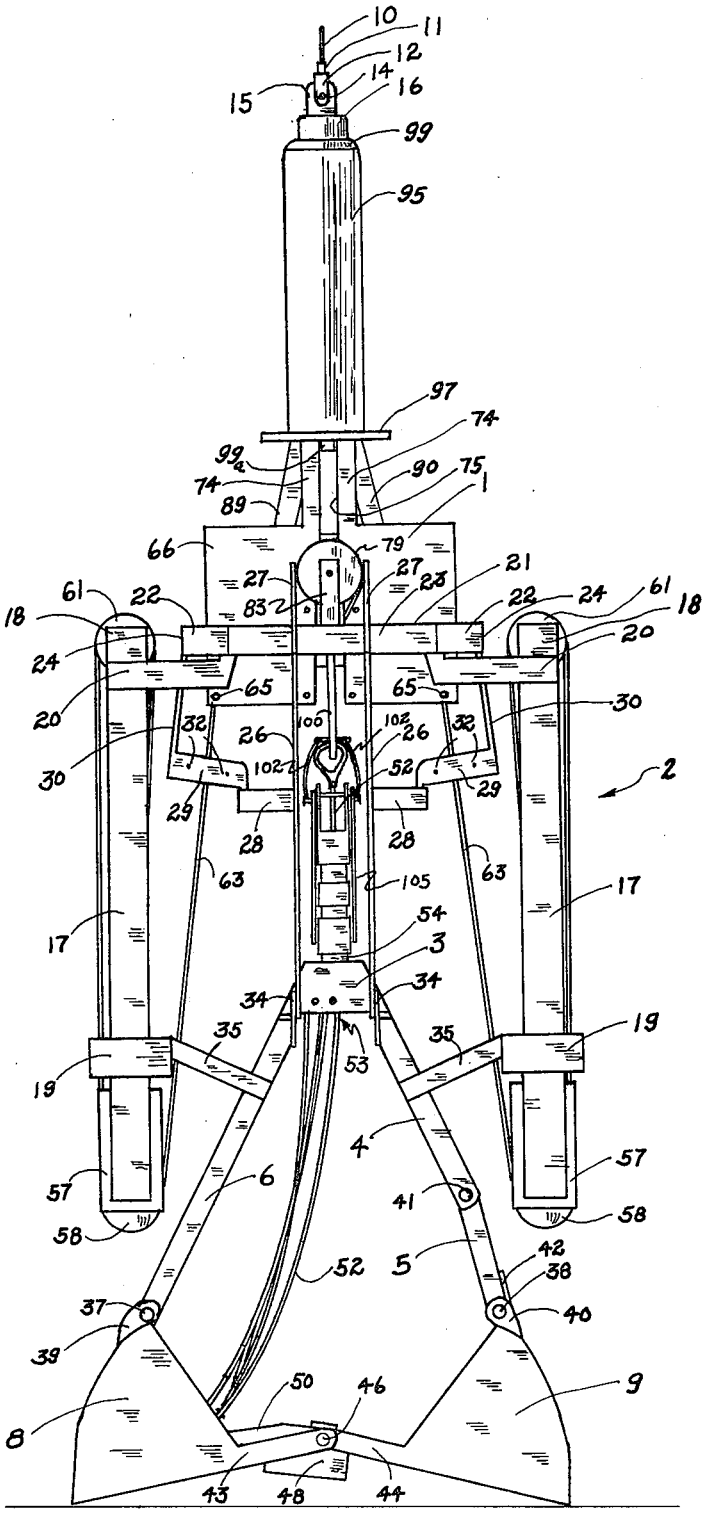
FIG. 1 is a plan or elevation view of the deep-sea bucket structure of the invention, showing the bucket in the normal open position with the hoisting frame seated in the cradle of the support frame.

Referring more particularly to the drawings, FIG. 1 discloses a general, overall view of the single line deep-sea bucket of my invention. The structure is shown as it would appear in an elevation view resting on the ocean floor immediately after descent, with the sea bucket having its clamshells open ready to receive a sample load from the ocean floor.

As pictured in FIG. 1, the overall structure comprises a hoisting frame 1 which is resting on the platform of a bucket support frame 2 which carries, by means of vertical supports, a bail housing 3 having a rigidly fixed upper link 4 which supports by means of the movable lower link 5 and the rigidly fixed main link 6 the open clamshells 8 and 9, respectively.

In this figure it can be seen that the hoisting frame 1 is supported by a single hoisting cable 10 through a swivel 11 and a swing coupling 12 attached by means of a pivot pin 14 to the vertical tongue 15 of a cylindrical spring guide 16.

The hoisting cable 10 which supports the deep-sea bucket structure of my invention is a single line connecting the structure with a support means on the surface of the ocean. The support means might normally be a barge or a ship which would be equipped with a hoisting crane and an appropriate frame for supporting the bucket structure when it is drawn with its cargo to the surface for emptying.

Because of the unique construction I have devised various types of support mechanisms which will be disclosed elsewhere, but which I have discussed in the operation of the structure which is the subject of this invention.

It must be borne in mind that the principle utility in this device lies in its use in deep-sea mining operations, where the distance between the surface supporting barge or ship and the deep-sea bucket structure lying on the ocean floor may vary from several hundred to several thousand feet, depending upon the location of the bed to be mined.

Over such great distances it must be remembered that deep-sea currents will tend to sweep the apparatus laterally for some distance and further cause a twisting or rotation of the structure in its ascent and descent relative to the hoisting cable. It is for this reason that a swivel connected single line hoisting cable should be used and any additional operating or tether lines should be guided and extend over short distances relative to the structure so that they cannot be fouled during operation.

Referring more particularly at this point to FIGS. 1, 7, 8, 9 and 10, it can readily be seen that the bucket support frame 2 and bucket assembly are comprised of essentially coacting parts. The basic structure is comprised of two opposed counterweight frames each having two vertical support beams 17 joined by a head block 18 at the top and a rectangular connecting frame 19 disposed along the beams 17 from the bottom as shown.

Located near the head block 18 on each of the beams 17 are corresponding pairs of horizontal side beams 20 which support a cradle 21 having opposed sides 22, 23 and 24, supporting on each side of the structure a platform 25.

Attached to opposite sides of the cradle are corresponding pairs of vertical supports 26. Each of these vertical supports is provided with an ear 27 which assists in seating the hoisting frame in the cradle as will be shown. Displaced from the top of the vertical supports 26 and attached to pairs thereof is a horizontal supporting frame or web 28. The web supports on each side a pulley housing 29 which is braced by a depending leg 30 from the cradle 21 above. Each pulley housing 29 carries a pair of opposing guide pulleys.

The lower end of each of the vertical supports 26 is provided with a horizontal supporting leg 34 which supports the bail 3 as indicated. Affixed to and depending from the bail housing 3 are the corresponding pairs of upper operating links 4 and main links 6 which support the clamshells 8 and 9 below. Corresponding pairs of link supports 35 are rigidly affixed to the connecting frame 19 which form a unitary structure with the vertical supporting beams 17 and the horizontal side beams 20 which are connected to the cradle 21.

The clamshells 8 and 9, respectively, are attached to the main link 6 and lower link 5 by means of the pivot shafts 37 and 38 extending through the corresponding ears 39 and 40 on each side of each clamshell. Each corresponding lower link 5 is connected to the upper corresponding link 4 by means of the pivot shaft 41.

Each of the pivot shafts, 37, 38 and 41 are set in bearings to be freely moving, although the clamshell 9 is restricted in its opening movement by means of a stop 42 attached to each of the respective ears 40 on this clamshell to restrict motion by impingement upon the link 5.

The respective clamshells 8 and 9 are pivotally connected through the corresponding arms 43 and 44 by means of a horizontal pivot shaft 46 which is rigidly affixed and welded to the arm 44 such that the arms 43 pivot about the outer ends of the shaft 46. There is rigidly affixed to the underside of the shaft 46 a stabilizing weight 48 which supports on its upper surface a biasing arm and pulley housing 50 centrally disposed relative to said shaft 46 to provide an operating lever for the clamshell. This structure can best be appreciated in FIGS. 7, 8, 9 and 10.

As can best be seen from the last referred figures, a pair of operating pulleys 51 are carried by the housing 50 and support corresponding laps of the operating cable 52 which are passed for a mechanical advantage over corresponding pairs of bail pulleys 53 located in the bail housing 3 such that the lead of the cable 52 extends upwardly through the bail and the operating bore in the bail tongue 54. This structure can best be seen in FIGS. 7, 8, 9 and 10, with the operational details shown in FIGS. 1, 2 and 3.

Referring now to FIGS. 1, 7, 8, 9 and 10, it will be seen that the vertical support beams 17 have their edges turned inwardly to form flanges 55 which result in a track 56 which will accomodate an inner projection of the counterweights, such weights being designated generally as 57, preventing the lateral displacement of the counterweights.

The counterweights 57 could take any number of different embodiments and shapes, so long as they may move freely vertically, confined between the side beams 17 in the manner which will be described. In the present embodiment shown, each counterweight is comprised of two halves 57*a* and 57*b* which consist of truncated semi-parabolic structures. Each half fits into the track on the side of the beam 17 and the two are joined at the bottom by a pulley housing 58 through which would pass a rigidly affixed shaft 59 accomodating a freely rotating pulley 60.

The head block 18 which joins the upper ends of the vertical support beams 17 is likewise divided by a pulley housing 61 which will carry the desired number of pulleys to achieve the mechanical advantage to lift the counterweight. As indicated in FIG. 1, and further shown in FIGS. 7, 8, 9 and 10, in the present embodiment the counterweights 57 are provided with a single tether cable 63 which, in each case, is attached at the pulley housing 58 of the counterweight, passed upwardly over the pulley system in the head block, downwardly over the pulley in the counterweight, and back upwardly between the guide pulleys 29 and 32 to a pin attachment 65 on each side of the hoisting frame 1.

FIG. 1 will show that when the hoisting frame is resting as will be described in the cradle 21, the counterweights 57 are maintained so that they are in a downward position slightly projecting beneath the ends of the vertical support beams 17 as shown.

Figures 4, 5, 6:
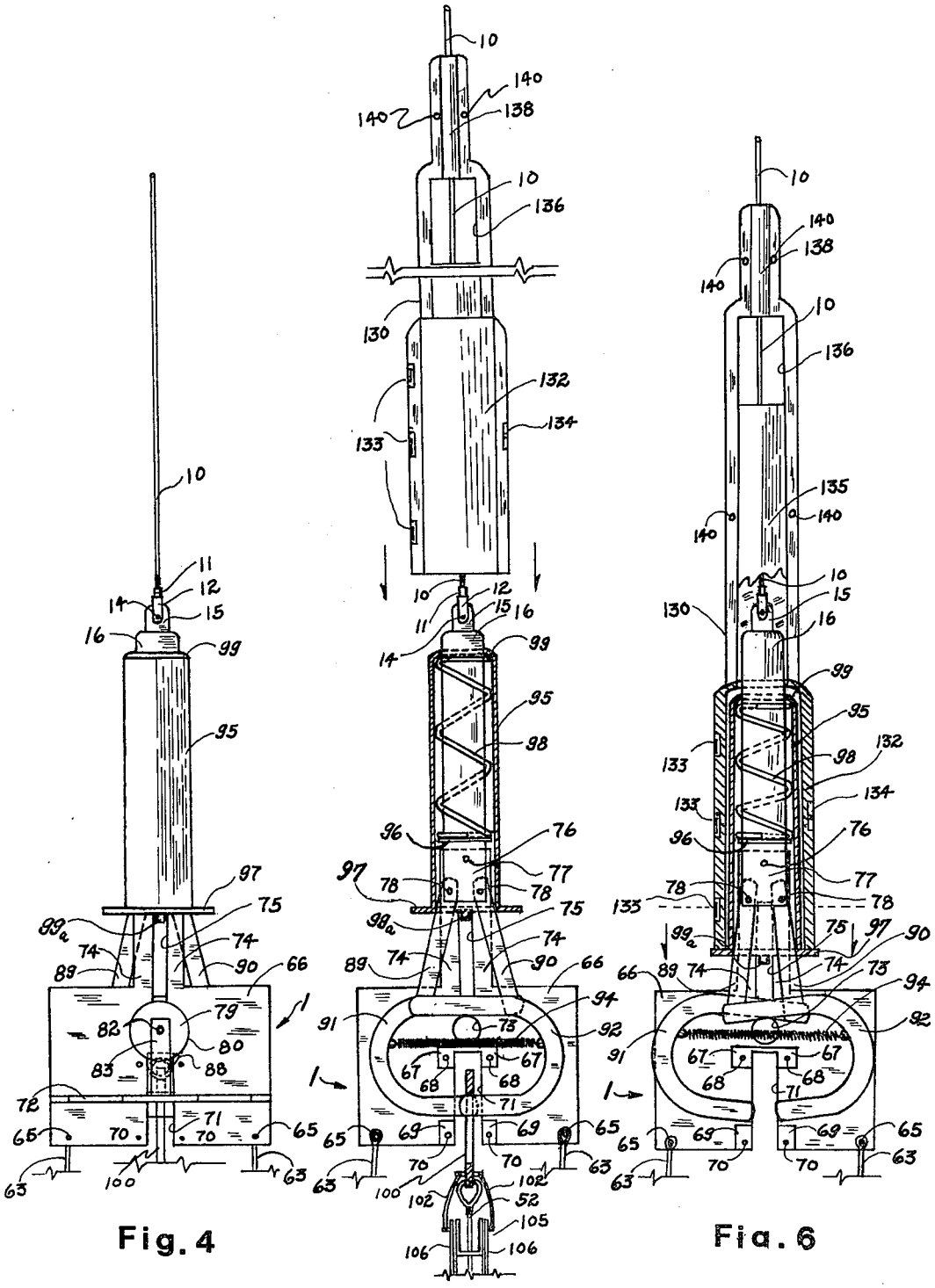
FIG. 4 is a plan or elevation view of the hoisting frame of the invention, as displaced from the bucket support frame, with the hoisting cable in place as the frame is used in normally hoisting the bucket frame.
FIG. 5 is a composite view of the hoisting frame, messenger tower foreshortened and part of the receiver, with one faceplate of the frame removed, to show the tongs retaining the buckle and receiver; and further, with a partial section through the tower to reveal the spring guide and tower in normal position before receiving the messenger tower.
FIG. 6 is a composite view of the hoisting frame, the messenger tower in place depressing the platform tower downwardly, with the messenger tower partly cut away and partly in section, the platform tower partially in section and one faceplate of the frame removed, to show the relative structures of the frame with the tongs open and the buckle released.

Now, it is necessary in order to appreciate properly the operation of this invention that one go to a description of the details of the hoisting frame which can best be seen in FIGS. 4, 5 and 6. Therein it can be seen that the hoisting frame generally designated by 1 has two essential components consisting of lower identical housing faceplates 66 which are attached together and maintained in spaced relation, front and back, by means of the spacers 67 and 69 which are held to retain the faceplates 66 in position by means of the pins 68 and 70, respectively. The pins 65 pass through the bottom of the plates 66 in spaced relation in such manner as to secure and pivotally hold the cables 63.

Each faceplate 66 is provided centrally with a vertically extending aperture passage 71 extending to the spacer 67 as shown for a purpose which will be explained below. Each faceplate 66 is also provided with a circular windlass axle passage 73 for a purpose which will be apparent.

A primary part of the structure of each faceplate 66 is a vertically extending arm 74 provided with a keyway 75 as shown.

As can be seen from FIGS. 5 and 6, the upper ends of the arms 74, being of solid construction, contain a retaining pin and spacer 76 to secure the tongue 77 at the lower end of the cylindrical spring guide 16. Also securing the tongue 77 with appropriate spacing are pivot pins 78 which support the tong structure to be described.

In the description of additional structure comprising the hoisting frame it would be necessary that our attention be drawn more particularly to FIGS. 4, 5, 6, 7 and 8. It can be seen, from FIGS. 4, 7 and 8, that the hoisting frame is provided with a windlass 79 on each side thereof which has rim wheels 80 and a drum 81 with an axle 82 supported by a stanchion 83.

The windlasses on each side of the hoisting frame communicate with each other through the windlass axle passage 73. However, as it can be seen from the drawings, a brake system is provided on only one side of the hoisting frame, as necessary. The hoisting frame and bucket support frame are turned in such direction in FIG. 7 that the braking system may be seen, while in FIG. 8 the hoisting frame and bucket supporting frame and other mechanism are turned around to give a view of the opposite side of the apparatus.

The brake has supports 85 communicating through an adjustable tension spring 86 with brake shoes 87 which come to bear on the outer rim wheel of the windlass.

As can be seen, the windlass and braking system are mounted on a seating platform 72 in which there is centrally disposed a semirectangular opening 84 to allow passage of the windlass cables 88 and the buckle apparatus to be described.

Figure 7:
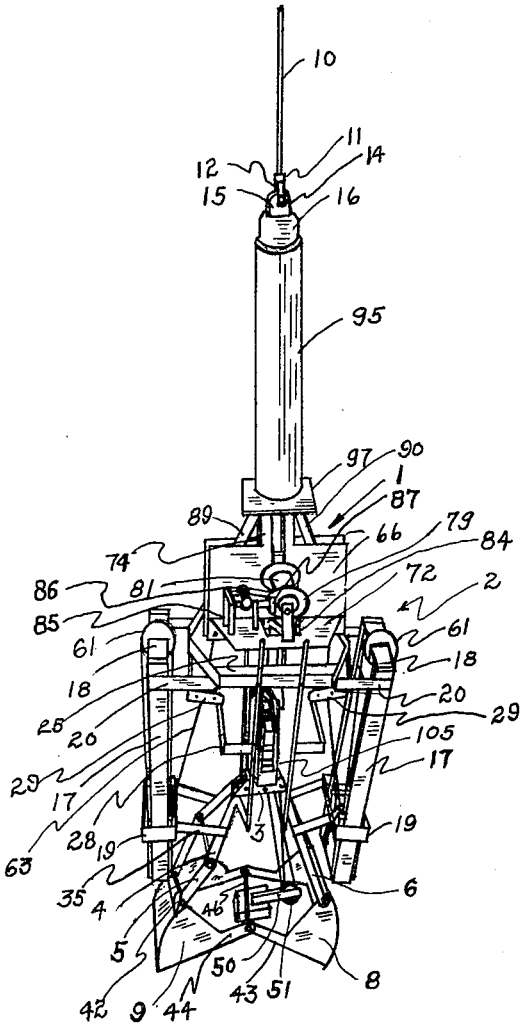
FIG. 7 is a frontal view, partly in perspective, looking downwardly at 45° on the sea bucket structure as it would be with the bucket open when first striking the ocean floor. The side of the structure showing the brake mechanism on the windlass faces the viewer with the operating linkage of the bucket to the left.
Figure 8:
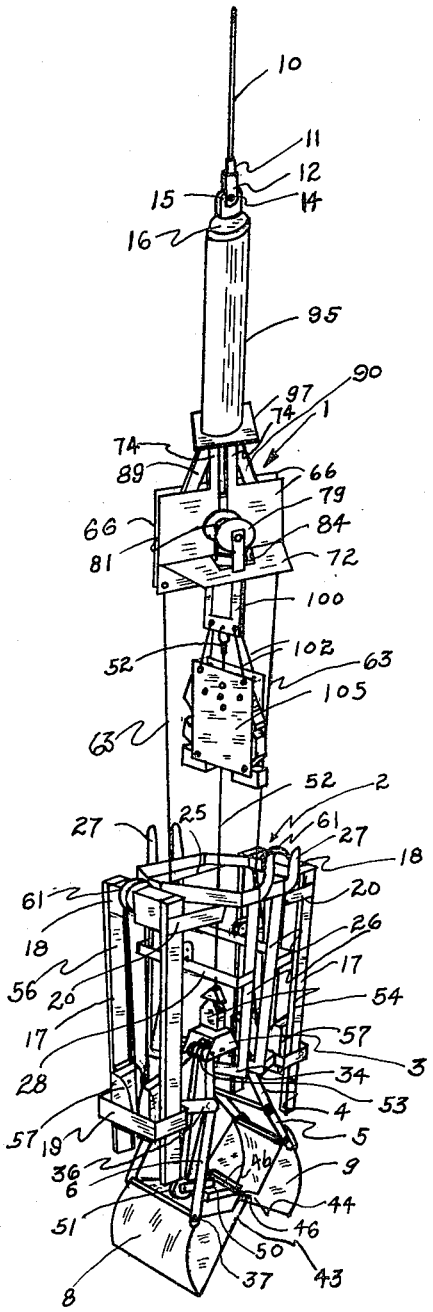
FIG. 8 is a view, partly isometric and in perspective, of the sea bucket structure, looking downwardly at approximately 45°, with the bucket beginning to close, the hoisting frame partly withdrawn with the receiver released from the tongue, and the counterweights moved slightly up from the bottom of their tracks. In this view, the entire structure has been turned around to show the side of the hoisting frame without the brakes, and the operating linkage of the bucket showing to the right.
Figure 9:
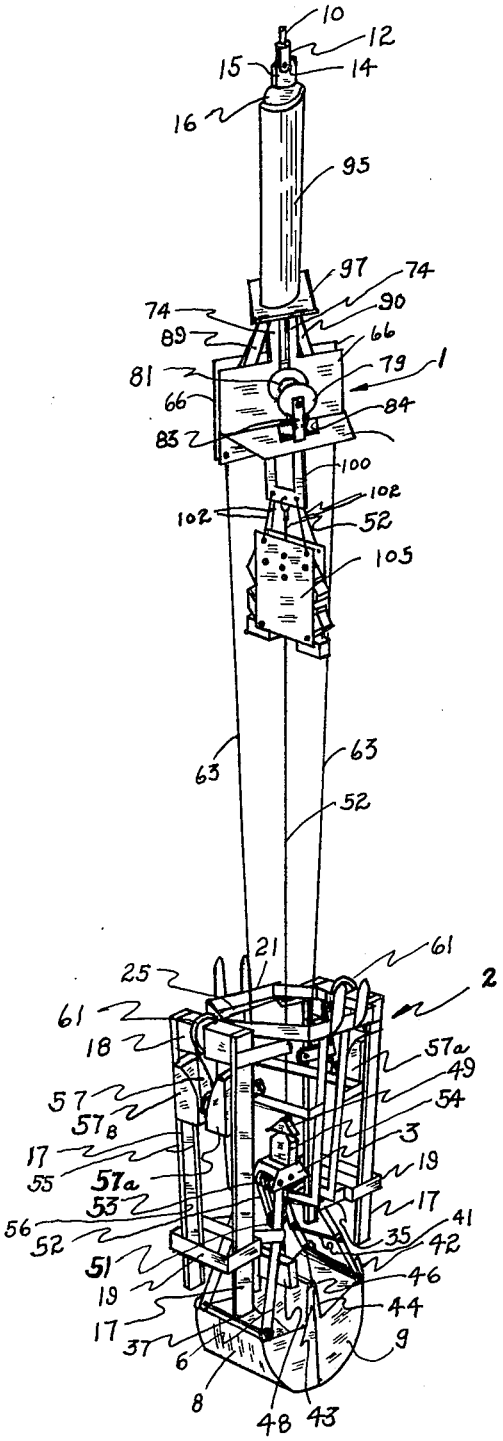
FIG. 9 is a view of the sea bucket structure, partly isometric and in perspective, as in FIG. 8, with the bucket fully closed and in the normal hoisting mode, the tether lines and operating cable fully extended, with the counterweights stopped fully raised. In this same view the bucket could be closed as hooked on an obstruction on the bottom.
Figure 10:
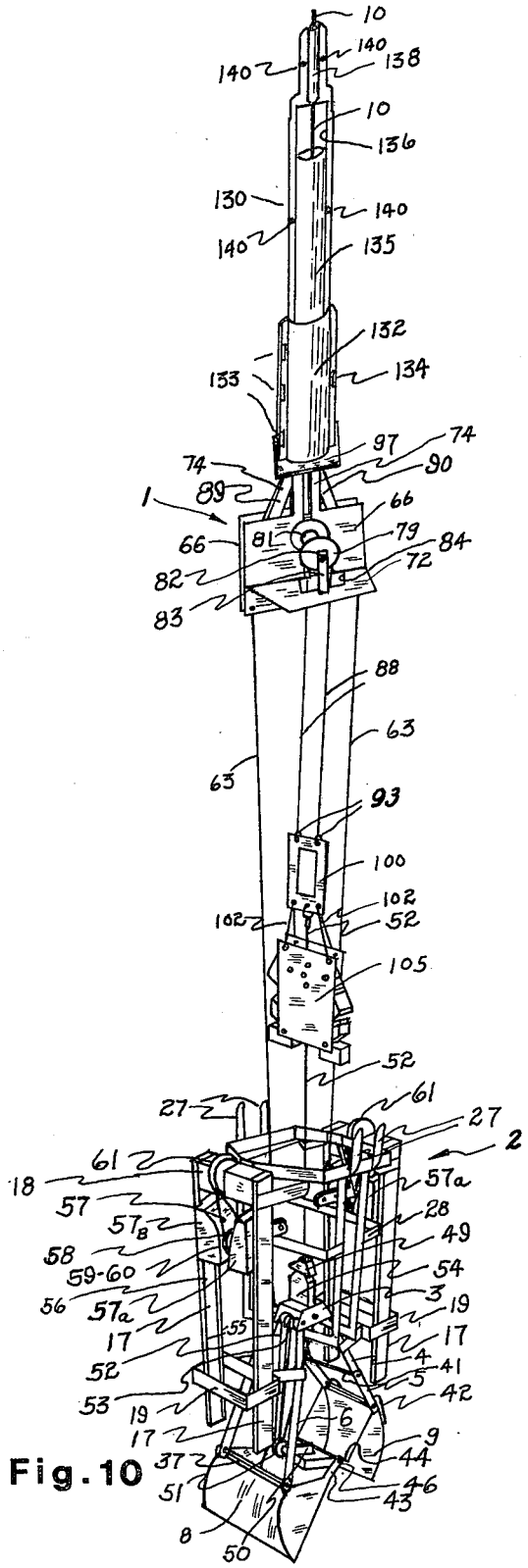
FIG. 10 is a view, partly isometric and in perspective, of the structure as in FIG. 9, showing the descended messenger tower resting on the platform tower, the same having actuated the release mechanism of the hoisting frame to release the buckle and receiver and lower the operating cable for emergency opening of the bucket.

It should be noted that in only one view, FIG. 7, is the hoisting platform turned to show the brake mechanism for the windlass, thereby placing the operating mechanism for the sea bucket and accompanying linkage on the opposite side of the frame from that shown in the views of FIGS. 8, 9 and 10. This has been done for the sake of clarity, and due to the fact that of necessity these figures must be of small scale in order to show properly the interrelation and operation of the bucket supporting frame and hoisting frame in operation.

The seating platform 72 has not been shown in invisible lines in FIGS. 5 and 6 because these views have been used principally to show the inside of the hoisting frame with the positioning and operation of the tongs.

Pivotally suspended by means of the pins 78 from the vertical arms 74 are a pair of downwardly inclined, precisely angled, arms 89 and 90, which arms, respectively, support intermeshing tongs 91 and 92, respectively. These tongs are semielliptical and are constructed such that the supporting arms 89 and 90 lie at the ends of the upper extended tangents of the respective tongs.

The tongs are maintained biased in a normally closed position by means of the tension spring 94. In the normally closed and meshed at the lower end mode, as in FIG. 5, it can be seen that the downwardly inclined arms 89 and 90 are in a position of extension with a more acute angle with the horizontal. On the other hand, it can be seen, as in FIG. 6, with the tongs 91 and 92 spread apart the arms 89 and 90 are compressed together at a more open angle with the horizontal. Otherwise stated, with the arms 89 and 90 spread apart, the tongs remain in the closed position, but with the arms 89 and 90 squeezed together, the tongs 91 and 92 are forced into the open position, as in FIG. 6.

The foregoing relationships are important because of the structure of the platform tower 95 and its function in the operation of the invention. The cylindrical spring guide 16 which is joined by spacers and pins to the arms 74 extends upwardly, having a retaining collar 96 on which rests the lower end of an extended coiled spring 98 encircling the guide. This spring in its fully extended position along the cylindrical spring guide 16 has a flattened loop at the top.

Positioned over the spring guide and extended spring, fitting snugly against the sides of the spring is the platform tower 95, having a suitable opening in the top with an inwardly turned annular lip 99 which impinges upon the top of the loop of the extended spring, in such manner that if the platform tower is moved reciprocally in a vertical direction it will compress the spring 98.

It is obvious that the extended coiled spring 98 is designed to normally maintain the platform tower 95 in the position as shown in FIGS. 4 and 5. The tower 95 is provided at its lower end with a square platform 97 so arranged that it has an annular passage the exact diameter of the inside of the tower 95.

It will at once be obvious that the platform tower must normally be maintained in the position shown in FIGS. 4 and 5 in order for the tongs 91 and 92 to remain in the closed position indicated in FIG. 5. Biasing means other than the large coiled spring 98 could naturally be used in place of such a spring to bias the tower and hold it in the position with the tongs closed as shown. For example, it might be possible to use a ring around the top of the guide 16 supported by a series of hydraulic shock absorbers maintained around the periphery of the guide 16 under the lip 99 of the tower and retained between said lip and the retainer collar 96. The spring is shown in the present embodiment because it is more economical and, with the proper tension, would achieve the desired result. Further attention is called to the fact that the lower end of the tower adjacent to the platform 97 is maintained in contact with the arms 89 and 90 such that the slightest downward movement of the tower will begin to draw these arms together and open the tongs.

It will be equally notable that other biasing means may be used in place of the tension spring 94. Actually, a spring capable of having both tension and compression may be desired to maintain the tongs 91 and 92 in exact contact in the closed position as indicated.

It can be seen from FIGS. 1, 4, 5, 8, 9 and 10, that the purpose of the tongs 91 and 92 is to hold in place a buckle 100 to the top of which is attached the windlass cables 88, by means of loop connections through the holes 93, and to the bottom of which is attached short tether cables 102 by means of plugs 103 in the holes 101. Through a center hole 104 there is attached by means of a loop and swivel 87 the operating cable 52.

Figure 2:
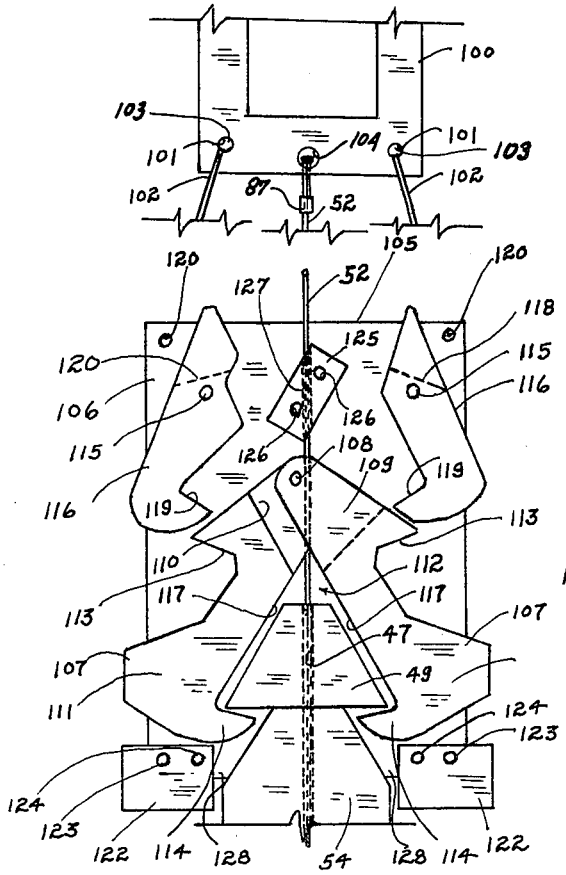
FIG. 2 is a plan or elevation view of the receiver, with a partial view of the buckle attached, in a relatively greatly enlarged size, with the front plate removed to show, in diagram, the position of the claws and dog arms, with a hoist cable and tongue in position.
Figure 3:
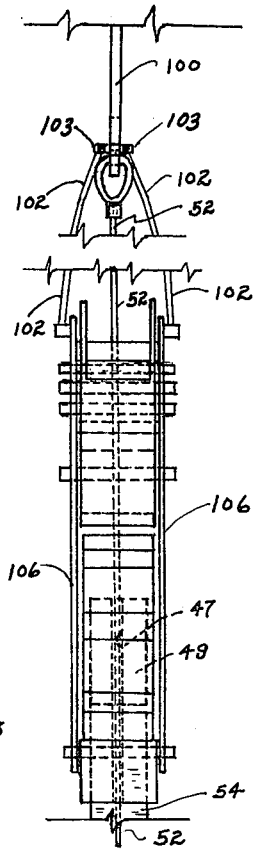
FIG. 3 is a side view of the receiver of FIG. 2, with the front and rear plates both in place, and the position of the cable and tongue as indicated, with a partial view of the buckle.

Referring now to FIG. 2, the short cables 102 permanently attach the buckle 100 to a very important component of the invention, the receiver 105, for which a cutaway plan view with one of the faceplates removed is shown in FIG. 2 and a side view is shown in FIG. 3.

As previously indicated, the receiver comprises a semirectangular shaped housing having front and back faceplates 106. In the drawing, as indicated, with one of the faceplates 106 removed, it can be seen that the component parts on he inside of the receiver are comprised essentially of a pair of claws 107 disposed at the lower end of the housing and pivotally connected by means of the pivot pin 108 such that they may freely move about this pivot point. Adjacent to the pivot pin 108, such that the upper ends of the claws may mesh and also provide an opening for the passage of operating cable 52 the outer claw 107 is provided with a cutaway channel portion 109, while the inner claw 107 is provided with a cutaway shoulder portion 110 to allow free movement of the outer claw on this surface.

It can be seen from the drawing that the structure of the claws 107 is such that the lower portion of the body 111 is of sufficient size and thickness to cause the claws to hang in the position shown in the drawing in normal mode due to gravity. This leaves an opening 112 between the hanging claws such that the teeth 114 will assume the position indicated.

Each one of the claws 107 is provided at its upper end with a precisely angled shoulder 113 whose purpose will be explained.

Pivotally connected by means of the pins 115 at the upper end of the receiver are a pair of arms or dogs 116, each having a cutaway channel 118 at its upper end as shown.

The dogs 116 have their upper ends provided with a cutaway portion in order to allow the lower ends of the dogs to be sufficiently heavy such that they will hang, by means of gravity, normally in the downward position as indicated with the teeth 119 of the dogs disposed in the relative position as shown above the shoulders 113 of the claws.

At the upper extremity in the corners of the receiver are located retaining pin holes 120 which are adapted to receive pivotal retaining pins connecting with the short tether lines 102 as indicated in FIG. 10. Depending upon the dictates of manufacturing technology, retaining pins can pass only through the face of the receiver plates 106, as indicated in FIG. 3, or they can pass all the way through the receiver projecting on each side of the faceplates 106.

The faceplates 106 are maintained fixed together and in their spaced relation by means of the utility of the pins 108 and 115, but are augmented by spacers 122 at the lower extremity of the receiver solidly fixed into position by means of retaining pins 123 and 124.

The upper end of the receiver is also provided with a spacer 125 which is retained in position at an angle by pins 126 to align an open channel 127 through which will pass the operating cable 52 as indicated in the drawing.

Again, referring to FIGS. 1 through 10, and particularly FIGS. 2 and 3, it can now be seen that the lower end of the receiver receives the upper end of the bail tongue 54 in the passage 128, disposed to receive the same by means of adjustment of the spacers 122.

The tongue 54 is provided with an axial lengthwise bore 47 which extends through the body of the tongue and the head 49 as shown. This bore receives the operating cable 52 which extends through the receiver, the open channel 127 in the spacer 125, the channel 109 in the claws 107, through the tongue and into the bail housing.

In the operating embodiment shown, the length of the tongue 54, and projection of the head 49, is such that when the receiver 105 envelopes the tongue 54 and is resting with the bottom of the spacers 122 on the bail housing, the head 49 pushes upwardly against the surfaces 117 of the claws 107 to spread the claws apart until the teeth 114 release the head of the tongue. At the same time, the spread of the claws 107 allows the teeth 119 of the dogs 116 to grip the shoulders 113 of the claws 107 and maintain the claws in the open position with the tongue released.

Due to the foregoing structure, it is essential that the short tether cables 102 be so adjusted that when the hoisting frame 1 is seated in the cradle 21 of the bucket support frame the receiver will come to a rest with a moderate amount of slack in the short tether lines and operating cable 52 in order to allow the claws 107 to be spread apart and release the tongue 54. In this manner, when the clamshell bucket reaches the floor of the ocean and the hoisting frame is allowed to seat itself by gravity, the receiver will also seat itself and release the tongue 54. When this has been accomplished, the hoisting frame 1 can be raised slightly out of the seat of the cradle 21 (FIG. 7) before the hoisting frame begins to draw the receiver upward, released from the tongue 54.

As the receiver 105 is raised along with the hoisting frame 1, released from the tongue, as indicated in FIG. 8, the operating cable 52 will be drawn upwardly, along with the tether cables 63 (which are attached to the hoisting frame at 65) to move the counterweights 57 slightly upwardly along the supporting beams as indicated in FIG. 8. The operating cable 52, passing over a guide pulley in the bail and the operating pulley 51 of the clamshell, cooperates with several laps over the operating pulleys and bail pulleys to actuate the arms 43 and 44 of the clamshells 8 and 9 to close them.

Finally, the operating cable 52 and the tether cables 63 are so arranged that when the hoisting frame has reached its highest position (as in FIG. 9) the counterweights 57 are resting in the upward position against the head block 18 and the clamshell has been fully closed by the operating cable 52 as shown in FIG. 9.

Several things should be noted about the fully extended position in FIG. 9. The receiver 105 held by the buckle 100 is secured within the hoisting frame by means of the tongs 91 and 92, which are intermeshed in their closed position, as best shown in FIG. 5.

Now, with the apparatus in the fully extended position, as in FIG. 9, it can be seen that it is ready to be hoisted to the surface with the bucket closed. Assuming that the bucket was closed, as shown, the apparatus is now being hoisted to the surface of the ocean with a single main hoisting cable 10, provided as aforesaid with a swivel connection 11, such that any twisting or turning of the apparatus would be done about this swivel, with the hoisting frame 1 and the bucket support frame 2 turning at the same time without any twisting action. The short tether lines 63 depending from the hoisting frame are merely a short distance above the bucket support frame 2 and are held in a straight position by means of the guide pulleys 32 on each side of the bucket supporting frame and the simultaneously taut operating cable 52.

At the same time, the mode of the apparatus shown in FIG. 9 (or possibly in the partially closed position of FIG. 8) would be same as that condition where the bucket had closed upon and locked itself to some obstruction on the ocean floor, such as a piece of wreckage or a rock or other like mass. Therefore, it is in this position that it becomes necessary to open the bucket on the ocean floor for an emergency situation. It is this very position, however, which dictates that there not be a long additional tether line extending from the bucket all the way to the surface of the ocean or any other type of line for operating the bucket mechanism extending all the way from the bucket to the surface of the ocean, for all of these lines can become fouled by the ocean currents and by the twisting motion caused thereby. Hence, means has now been provided without the necessity of additional lines from the surface to open the bucket in this emergency position.

The emergency bucket opening means is now best illustrated by the apparatus shown in FIGS. 4, 5, 6 and 10, assuming that the bucket was in the locked closed position in FIG. 9. Remembering that the platform tower 95 is reciprocally movable upwardly and downwardly along the spring guide 16, thereby converging the arms 89 and 90 to open the tongs 91 and 92, we have provided a messenger tower 130, best seen in FIGS. 5, 6 and 10, for the purpose of actuating the movement of the platform tower 95.

It will be seen that the messenger tower 130 is provided with a lower body portion having two halves 132 provided with hinges 133 on one side and a locking latch 134 on the opposite side. The messenger tower is so cylindrically shaped that it is adapted to fit perfectly over the platform tower 95 with its two bottom cylindrical halves 132 closed in the position shown in FIG. 5. The messenger tower 130 is further provided with a shank 135 which, when the messenger tower is in position, will accomodate the upper part of the spring guide 16 as shown in FIG. 6. The tower is also provided with an open section 136 to allow fluid to escape as it may descend into the ocean. There is also provided a guide track 138 at the top and there are auxiliary fasteners 140 located along the shank portion and the guide track portion to assist in securing the two halves of the messenger tower together.

It can be seen that the messenger tower can be so constructed that it has additionally weighted sides or ballast material added thereto in order to provide the necessary weight for the same to descend quickly to the ocean floor.

Assume that the bucket is in the locked position as shown in FIG. 9, and, further, that the bucket is locked around a piece of wreckage or some other obstruction on the bottom of the ocean floor. It is now necessary to release or open the bucket in order that it might be drawn to the surface. Up on the ocean surface, at the barge or ship where a derrick or crane holds the hoisting cable 10, the open messenger tower is wrapped around the hoisting cable, with the guide track 138 in place and the cable extending downwardly through the shank 135 and out the bottom of the messenger tower 130. This tower is now released and allowed to descend by gravity very quickly to the ocean floor where it approaches the platform tower as shown in FIG. 5. As soon as the messenger tower strikes the platform tower at its bottom end as shown in FIG. 6, the platform tower will be moved downwardly as shown in FIG. 6 converging the arms 89 and 90, and thereby opening the tongs 91 and 92 to release the buckle 100.

When the tongs 91 and 92 release the buckle 100 the windlass cables 88 unwind under the tension of the spring brake and, while the tether cables 63 remain in full extension, allow the receiver 105 to descend rapidly lowering the operating cable 52, as shown in FIG. 10, allowing the clamshells 8 and 9 to open while the bucket supporting frame 2 remains in the same position.

After this bucket supporting frame has been actuated to open the bucket or clamshells in such an emergency situation, the messenger tower, hoisting frame and bucket support frame are all hoisted to the surface of the ocean by the crane where the bucket support frame 2 is engaged by a suitable supporting frame, the dogs 116 and claws 107 are tripped and the receiver allowed to descend back into position on the tongue 54, where it locks itself to the tongue in a normal manner.

In this operation at the surface an electric motor or crank can be applied to the windlass 79 to rewind the cables 88; the messenger tower can be lifted free of engagement with the platform and the buckle 100 allowed to be secured once more by the tongs 91 and 92. With the lowering of the hoisting frame at the surface, the tether cables 63 are again shortened such that the counterweights 57 again descend to the bottom of the vertical support beams 17.

With the messenger tower completely freed from the hoisting frame, the hoisting frame seated in the cradle and the receiver locked onto the tongue, the entire apparatus is again ready to be hoisted over the side and lowered back to the ocean floor with the bucket in the open position ready for mining operations.

It will be noted that the platform 97, at the bottom of the platform tower 95, is provided with a key bar **99*a* which travels in the key way 75. This limits the upward movement of the platform tower 95, and also limits its lower movement when it is caused to travel downwardly, as indicated in FIG. 6, to converge the arms 89 and 90. It is assumed in manufacturing that this key bar 99*a* would be detachably affixed to the platform 97 in such manner that the entire apparatus could be disassembled to easily expose the cylindrical spring guide 16 with its compressing spring 98**.

Now, it can be seen that I have provided a sea bucket apparatus for mining the ocean floor which is easily operable at great depths without fouling of the hoist lines. This is a single line bucket, having only one hoisting cable 10 which extends to the surface of the ocean.

At the same time, the opening and closing mechanism for the clamshell is a unitary structure, having the operating cable 52 and the tether lines 63 extending over a very short distance adjacent to the bucket supporting frame, where they serve as guide lines in the operation of this apparatus in such manner that there is no way in which they can become fouled. They are guided at each point.

Referring to the apparatus as shown in FIG. 1, it can be seen that this unitary structure comprises, essentially, the very important bucket supporting frame 2 which has components attached to the bail 3 supporting through appropriate linkage the clamshells 8 and 9.

This supporting frame 2 supports in a suitable cradle 21 the hoisting frame 1 to which, through the cylindrical spring guide 16, is attached the hoisting cable 10.

When the mechanism is lowered to the ocean floor, it is lowered essentially in the relationship shown in FIG. 1, with the clamshells 8 and 9 in the open position, but with the hoisting frame normally slightly retained above the cradle 21; with the receiver 105 connected to the tongue 54 of the bail 3, pulled upwardly in a slightly extended mode, as shown in FIG. 2.

When the sea bucket mechanism reaches the ocean floor, the hoisting frame 1 is allowed to suddenly seat itself in the cradle 21, allowing the receiver to travel downwardly and out of the extended position, causing the claws 107 to move downwardly against the shank of the tongue 54, where they are wiped off of the underside of the head of the tongue 49. The lower portion of the claws designated at 111 by virtue of the curvature of the teeth 114 are assisted in this operation by the sides of the tongue and the spacers 122.

Thus, when the apparatus is seated on the ocean floor as indicated in FIG. 1, it is now ready for the hoisting upward movement which will begin to close the clamshells 8 and 9.

It can be seen that we have accomplished another object in thus providing a bucket structure which can be cocked to be closed on the bottom of the ocean without the necessity of additional surface-to-bucket operating lines, and the bucket has been allowed to be lowered in the open mode such that it can be automatically cocked into closing mode at the bucket frame without the further necessity of linkage to the surface.

Then, by examining FIGS. 7, 8, 9 and 10, (with a view of FIG. 1 before you), it can be remembered that the receiver in the position shown in FIG. 1 has now been released from the tongue 54 by the opening of the claws and the apparatus is ready for the hoisting and closing of the clamshells.

Thus, the hoisting frame is pulled upwardly by the mechanism at the surface of the ocean, pulling the receiver free of the bail tongue 54, at the same time pulling upwardly on the operating cable 52 which actuates the pulleys 53 and 51 to lift the clamshell arms and close the clamshells 8 and 9, in the sequential steps shown in FIGS. 7, 8 and 9.

As the hoisting frame 1 is lifted further away from the bucket supporting frame, the tether lines 63, assisted by the guide pulleys 32, manage the normal closure of the bucket by lifting the counterweights 57 along their tracks in the supporting beams 17 with the upward movement coinciding with the counterweights 57 striking the head block 18 of the bucket supporting frame at the same time that the tether lines 63 reach full extension and the operating cable 52 has been pulled into the extended position in FIG. 9 to fully close the clamshells. This is shown in FIG. 9, which figure would also represent the situation which would occur when the bucket clamshells were fully closed and locked upon some foreign object or hung upon a rock on the bed of the ocean.

In such a mode as described above, it would now be necessary to release and open the bucket. I have provided a means for doing this without the necessity of an additional line extending from the bucket frame to the surface; which line would undoubtedly be subject to fouling under normal conditions.

Instead, I have provided the messenger tower 130 which, as previously explained, in such an emergency situation is quickly affixed around the hoisting cable 10 at the surface in such manner that the halves of the lower part of the messenger tower are closed and locked with the hoisting cable resting in the guide track 138. This messenger tower is released, with appropriate ballast and weight, and allowed to very quickly descend to the floor of the ocean, where it slides over the platform tower 95 and strikes the platform 97, causing the platform tower 95 to move downwardly as shown in FIG. 6, converging the arms 89 and 90 and releasing the buckle 100. This allows the buckle to immediately travel downwardly, extending the windlass cable 88 against the spring biased brakes on the rim wheels 80.

The foregoing procedure quickly allows the receiver, which is permanently attached to the lower portion of the buckle 100 to quickly descend along with the operating cable 52 to open the clamshells 8 and 9 as shown in FIG. 10.

After the device is opened, as above, the hoisting cable 10 is pulled back to the surface along with the bucket supporting frame, the tether cables 63 extended over their short distance as well as the receiver downwardly descended toward the tongue 54 with the short length of windlass cable 88, all of such short tether lines, as a part of the unitary structure, guided into their respective positions such that they will not foul at that point.

At the surface of the ocean a suitable frame, with suitable loops for arms on the supporting beams 17 will be provided such that the bucket supporting frame may be seated on the frame which resides on the barge or ship at the surface, the messenger tower removed from the apparatus, and the hoisting frame again allowed to descend into the cradle 21; and the receiver 105 again allowed to grasp the tongue 54. With the hoisting frame 1 seated in the cradle, or rather just slightly suspended above the same, as shown in FIG. 7, the entire apparatus is now ready to descend to the ocean floor again for operation.

Thus it will be seen that I have provided an entirely different type of sea bucket apparatus, operating upon an entirely different principle, which is most suitably adapted to meet all of the objects and features hereinbefore set forth.

From the foregoing it will be seen that the invention is well adapted to attain all of the ends and objects, together with other advantages which are obvious and which are inherent to the structure.

It will be understood that certain features of any subcombinations of the invention are of utility and may be employed without reference to other features and subcombinations. This is contemplated by and is within the scope of the claims.

As many possible embodiments of the invention may be made without departing from the scope thereof, it is to be understood that all matters set forth or shown in the drawings are to be interpreted as illustrative and not in a limiting sense.

Having thus described my invention, what is claimed is:

1. A single line deep-sea bucket and release comprising in combination:

a hoisting frame connected by a single hoisting cable to the operating water surface area;

a bucket support frame measurably displaceable downwardly from said hoisting frame a selected operable distance;

nesting means on said bucket support frame and hoisting frame to selectively receive and seat said hoisting frame and bucket support frame in nesting engagement;

said bucket support frame having a bail with an upward grippable projection thereon and dependent linkage supporting a clamshell with cable operating means thereon activating the opening and closing of said shell responsive to the measured withdrawal of said hoisting frame from the bucket support frame;

tether lines depending from said hoisting frame and connecting said hoisting frame and bucket support frame and guide means on the support frame limiting and guiding the relative displacement of the hoisting frame therefrom;

coupling means disposed between said grippable bail projection and the hoisting frame displaceably securing the end of said cable operating means of said clamshell to hoist and operate the same;

locking means on said hoisting frame releasably securing said coupling means, with auxiliary guide means therebetween guiding and preventing torsion descent of said coupling means, and allowing a selective release and descent of said cable operating means and an emergency opening of said clamshell;

and emergency release means on said hoisting frame integral therewith and coacting with a messenger received along said single hoisting cable to release said locking means for said coupling and activate an emergency opening of the clamshell in the depths of said body of water.

2. A single line deep-sea bucket and release as in claim 1, wherein said nesting means comprises:

a cradle with a circumferential platform disposed on said support frame and laterally extending flange platform members on said hoisting frame configured to be received by said cradle platform.

3. A single line deep-sea bucket and release as in claim 1, wherein said upward grippable projection on said bail comprises:

an upwardly extending tongue with diverging overhanging shoulders and an axial passage therethrough for said operating cable means.

4. A single line deep-sea bucket and release as in claim 1, wherein said dependent linkage from the bail comprises:

at least one pair of flexing opposing arms supporting a clamshell depending therefrom, operable to open and close about an axial common pivot through a pulleyed biasing arm.

5. A single line deep-sea bucket and release as in claim 1, wherein said cable operating means on said bucket support frame comprises:

a cable secured to pass to mechanical advantage over pulley means on a pivotal biasing arm on said clamshell and pulley means on said bail, and further extend upwardly from said support frame securely connected to said hoisting frame and activated by the movement thereof.

6. A single line deep-sea bucket and release as in claim 1, wherein:

said guide means on the support frame limiting and guiding the relative displacement of the hoisting frame therefrom comprises:

a pair of guide pulley groups on said support frame, laterally aligned relative to said cradle, receiving and guiding said tether lines from the hoisting frame;

counterweights on said support frame affixed to the terminal ends of said tether lines;

and guide tracks on said support frame receiving said counterweights reciprocally movable thereon responsive to the movement of said hoisting frame and limiting the displacement thereof proportional to the operating distance to close said clamshell and hoist the same.

7. A single line deep-sea bucket and release as in claim 1, wherein said coupling means comprises:

a receiver consisting of a housing having a passage at the lower end thereof receiving the upward interlocking projection of said bail;

automatically pressure releasable claw means therein selectively engaging said bail tongue;

an axial bore through said claw means passing the operating cable of the clamshell;

a buckle clasp above said receiver suspending the same and said operating cable;

a clasping aperture on said buckle receiving releasable locking means on said hoisting frame;

and selectively descending cable guides attached to the top of said buckle and depending from said hoisting frame, guiding the released descent of said buckle and receiver.

8. A single line deep sea bucket and release as in claim 1, wherein said locking means on the hoisting frame comprises:

said hoisting frame having a pair of vertical opposing faceplates in spaced relation;

vertical upwardly extending arms from said faceplates supporting a vertical guide member attached to a hoisting cable;

downwardly depending, normally biased diverging, tong arms extending from said guide member;

said tong arms supporting abutting intermeshing converging-release tongs within said faceplates disposed in the opening of a receiving aperture for a coupling means clasped thereby;

and a reciprocating platform tower fitted over said guide member with a platform in contact with said tong arms selectively responsive to downward pressure thereon to converge said arms and open said tongs to release said coupling.

9. A single line deep-sea bucket and release as in claim 1, wherein said auxiliary guide means on said hoisting frame comprises:

a pair of laterally displaced windlass cable retaining means located on opposite sides of said hoisting frame and the locking means disposed therein securing the coupling means;

guide cables retained by each of said windlass retaining means having their lower ends attached to the respective laterally spaced upper edges of the coupling means for said bucket support frame and cable operating means for said clamshell releasably retained by said locking means;

and spring loaded brake means in connection with each of said windlass means measurably regulating the lowering and guiding the path of the released coupling means.

10. A single line deep-sea bucket and release as in claim 1, wherein said emergency release means on said hoisting frame coacting with a messenger received along said single hoisting cable, comprises, in combination:

a weighted messenger attachable to said hoisting cable at the water surface and selectively rapidly descendable along said cable to the submerged hoisting frame;

and said messenger sufficiently weighted and configured in conjunction with said hoisting frame to be received thereby in forceful occlusive contact by a platform tower on said frame with sufficient downward force at the terminal point to converge tong arms in contact with said tower such as to release the tongs and therefrom coupling means for a clamshell operating cable, activating the opening of said shell.

11. A single line deep-sea bucket and release comprising, in combination:

a bucket support frame having affixed depending therefrom a clamshell;

a hoisting frame having a vertically extending upper end and a downwardly depending lower end, with a single hoisting cable connecting the upper end of said frame to the operating surface of the sea;

coupling means disposed between said bucket support frame and hoisting frame, operably secured to maintain a fixed connection between said frames on descent with the clamshell in a normally open mode;

release means on said coupling means operable to selectively release, depending therefrom, said bucket support frame;

an operating cable on said clamshell for opening and closing the same extending through said coupling means and secured thereby to the hoisting frame;

retractable cable guide means located on said support frame and secured to the depending lower end of said hoisting frame, said guide means, in cooperation with said operating cable, operable to allow a measured withdrawal of the hoisting frame upwardly from the support frame, activating the operating cable secured to the hoisting frame, within said measured withdrawal limits of the guide cable means, to close said clamshell and hoist the same to the surface;

releasable locking means and adjacently disposed windlass guide cables on said hoisting frame secured to said coupling means, operable to be activated to release from said locking means said coupling means and the attached operating cable, such as to cause said coupling means and connected terminal end of the operating cable to descend on the windlass guide cables from the hoisting frame within the measured withdrawal distance between said frame and the bucket support frame for emergency opening of the clamshell;

a release for the hoisting frame locking means comprising a normally upwardly biased vertically reciprocal weight-responsive platform, in line with the hoisting cable, actuated by striking in downward force to move and disengage said locking means;

and a descending messenger weight selectively operable to descend said hoisting cable from the surface such as to strike the release platform of said hoisting frame locking means to activate the same for release of said coupling means therefrom to open said clamshell.

12. A single line deep-sea bucket and release as in claim 11 wherein said:

releasable locking means on the hoisting frame comprises, in combination:

a pair of intermeshed tongs biased in the normally closed position having a pair of upwardly converging arms pivotally anchored to a vertical guide member which is connected in line to the hoisting cable;

a receptor platform tower member having a lengthwise downwardly open channel disposed along and receiving in said channel said guide member, said tower member being normally biased upwardly with the lower edge of said channel at the opening resting in downward contact with the upwardly converging and downwardly diverging tong arms which are normally biased outwardly, such that a downward movement of said receptor platform tower member converges and releases the intermeshed ends of said tongs.

* * * * *